US009056221B2

(12) United States Patent
Anderson et al.

(10) Patent No.: US 9,056,221 B2
(45) Date of Patent: Jun. 16, 2015

(54) EXERCISE MACHINE WITH WEIGHT PLATE STACK ALIGNMENT FEATURE

(71) Applicants: Ace Specialty, Inc., Rosemead, CA (US); Grace Premier Fitness and Wellness Products, Inc., Vancouver, WA (US)

(72) Inventors: Karl Anderson, Glendora, CA (US); Mark Harigian, Glendale, CA (US)

(73) Assignees: Ace Specialty, Inc., Rosemead, CA (US); Grace Premier Fitness and Wellness Products, Inc., Vancouver, WA (US)

( * ) Notice: Subject to any disclaimer, the term of this patent is extended or adjusted under 35 U.S.C. 154(b) by 197 days.

(21) Appl. No.: 13/804,310

(22) Filed: Mar. 14, 2013

(65) Prior Publication Data

US 2013/0244841 A1 Sep. 19, 2013

Related U.S. Application Data

(60) Provisional application No. 61/610,687, filed on Mar. 14, 2012.

(51) Int. Cl.

| | |
|---|---|
| ***A63B 21/00*** | (2006.01) |
| ***A63B 21/062*** | (2006.01) |
| *A63B 21/06* | (2006.01) |

(52) U.S. Cl.

CPC ..... *A63B 21/062* (2013.01); *A63B 21/0601* (2013.01)

(58) Field of Classification Search

USPC ..... 482/106, 104, 98, 99, 92, 93

See application file for complete search history.

(56) References Cited

U.S. PATENT DOCUMENTS

| | | | | |
|---|---|---|---|---|
| 4,988,095 | A * | 1/1991 | Ferrari | 482/102 |
| 5,374,229 | A | 12/1994 | Sencil | |
| 6,193,635 | B1 | 2/2001 | Webber et al. | |
| 2004/0009856 | A1 * | 1/2004 | Hammer | 482/99 |

* cited by examiner

*Primary Examiner* — Jerome w Donnelly

(74) *Attorney, Agent, or Firm* — Robert A. Seldon

(57) ABSTRACT

User-manipulated exercise equipment of the type utilizing a weight-plate stack comprises a stack of weight plates, of which a user-selected portion moves as a unit along a pair of guide rods in response to an exercise movement by the user. The selected portion of the stack moves with virtually no cross-wise (i.e., lateral) shifting among the plates and virtually no friction between the moving portion of the stack and the guide rods because (1) a keystone bushing below the weight plate stack provides virtually error free alignment with the guide rods by setting the non-selected portion of the stack at a highly accurate "home" position that resets the moving stack if it has shifted laterally during movement, even if that shift is very slight, and (2) the guide rod holed in the weight plates carry bushings which align with the bushings of the adjacent weight plates to prevent the plates within the moving portion of the stack from shifting laterally with respect to each other and thereby contacting a guide rod. Preferably, the topmost weight plate in the moving portion of the stack carries bushings forming a smaller gap with the guide rods than the bushings of the remaining weight plates so that, at worst, only the topmost plate will contact a guide rod resulting in negligible friction.

19 Claims, 2 Drawing Sheets

EXERCISE MACHINE WITH WEIGHT PLATE STACK ALIGNMENT FEATURE

CLAIM OF PRIORITY AND INCORPORATION BY REFERENCE

Priority of U.S. Provisional Patent Application No. 61/610,687 filed Mar. 14, 2012 is hereby claimed.

BACKGROUND OF THE INVENTION

The present invention is related to user-manipulated exercise equipment utilizing a weight-plate stack comprising a plurality of stacked weight plates.

The typical weight plate in the stack has a generally vertical central hole, through which a selector rod passes downwardly from a cable that couples the rod to a user-manipulated bar or handle via one or more pulleys. The selector rod typically has a series of vertically-separated, generally horizontally-extending holes that generally align with a like series of vertically-separated, generally horizontally-extending openings in the weight-plate stack, one for each plate in the stack. Each plate in the stack accordingly has a transversely-extending opening extending from the front of the weight plate to at least the central opening. A selector pin can thereby be inserted through the transverse opening associated with a selected weight in the stack, and into the aligned hole in the selector rod, so that the selected weight plate and all weight plates above it in the stack are lifted by a user via the handle/bar, selector rod and connecting cable. The amount of resistance lifted can therefore be adjusted by relocating the selector pin to a higher or lower weight in the stack.

As it travels generally vertically up and down in response to the user's exercise movement, the stack is typically guided by a guide rod system. Each weight plate in the stack has one or more guide rod holes that extend through the weight plate generally parallel to the central hole that accommodates the selector rod. The apparatus, of which the stack is a component, provides one or more generally vertically-extending guide rods that are positioned to pass through the guide rod holes of the weight plates in the stack.

Those of ordinary skill in the art will recognize that the weight plates within the stack can shift with respect to each other during movement. This generally arises because of manufacturing tolerances in the location and diameters of the plates' openings and/or holes that accommodate the guide-rod(s), the selector rod and the selector pin. The slight degrees of size and positional error can result in the plates rubbing against the guide rods, creating friction or drag that can be felt by the user. Similarly, positional errors give rise to alignment errors between the vertically-separated holes in the selector rod and the respective selector pin-accommodating holes/openings associated with in the weight plates, making it difficult and/or annoying to insert and remove the selector pin when adjusting the amount of weight to be lifted; users must sometimes even need to jiggle the handle/bar of the apparatus in order to create the momentary alignment needed to remove or insert the selector pin.

Another issue pertaining to non-aligned weight plates in the stack is particularly noticeable with "high-end" machines using stainless steel weight plates or weight plates of other reflective materials. As the plates are raised and lowered, they become slightly misaligned owing to the same manufacturing tolerances discussed above, and the stack exhibits an unattractive appearance. The problem is particularly acute with reflective materials because the human eye is very sensitive to slight differences in the angles of reflection that result from the misalignments.

Lastly, non-aligned weight plates affect the effectiveness of a workout in a profoundly subtle way. A weight-lifting exercise movement generally comprises two phases: a positive and a negative. The positive (or "concentric") contraction is the phase in which the targeted muscle group contracts to move the weight from a first position to a second position. The negative (or "eccentric") phase of the movement occurs as the weight is returned from the second position to the first. During the negative phase, the targeted muscle fibers lengthen, but the muscles are still working and contracting in order to control the speed at which the weight returns to the first position.

During the negative phase, a person can work against approximately 40% more weight than (s)he can during the positive phase; i.e., a person is "stronger" during the negative phase. So, for example, one is capable of lowering 140 lbs to the aforedescribed first position if one can raise 100 lbs. to the aforedescribed second position.

Assuming that non-aligned plates result in a 10% friction loss, which appears to be a reasonable estimate, a person capable of raising 110 lbs can only raise 100 lbs of weight plate mass, since friction is adding 10 lbs to the encountered resistance. However, during the negative phase, the person is only working against 100 lbs. of resistance during a phase when (s)he is capable of working against 140% of 110 lbs., or 154 lbs.

Accordingly, the non-aligned plates cause a resistance adjustment in the wrong direction during the negative phase. If friction can be eliminated, the lifter can resist 110 lbs of weight plate mass during both phases, yielding a better workout during the negative phase and a more accurate assessment of actual weight moved.

These and other details concerning the invention will be apparent from the following description of the preferred embodiment, of which the drawings form a part.

SUMMARY OF INVENTION

In accordance with the invention, friction between the moving stack of weight plates and the guide rods is substantially eliminated with a configuration that provides relatively tight alignment between the guide rods and at least one of the weight plates in the weight plate stack (hereinafter, the "guide plate"), a relatively looser "clearance fit" alignment between the remaining weight plates in the weight plate stack and the guide rods, and alignment members carried within the guide rod holes of the weight plates to align the weight plates with the guide rods via plate-to-plate alignment.

In operation, the moving stack portion experiences little or no contact with the guide rods owing to the accuracy of the guide plate's positioning together with the plate-to-plate alignment feature and the relatively looser "clearance fit" (and consequently greater gap) between the remaining plates' guide rod holes and the guide rods.

These and other details concerning the invention will be apparent from the following description of the preferred embodiment, of which the drawings form a part.

DESCRIPTION OF THE DRAWINGS

In the preferred embodiment.

DETAILED DESCRIPTION OF THE PREFERRED EMBODIMENT

Figure 1:
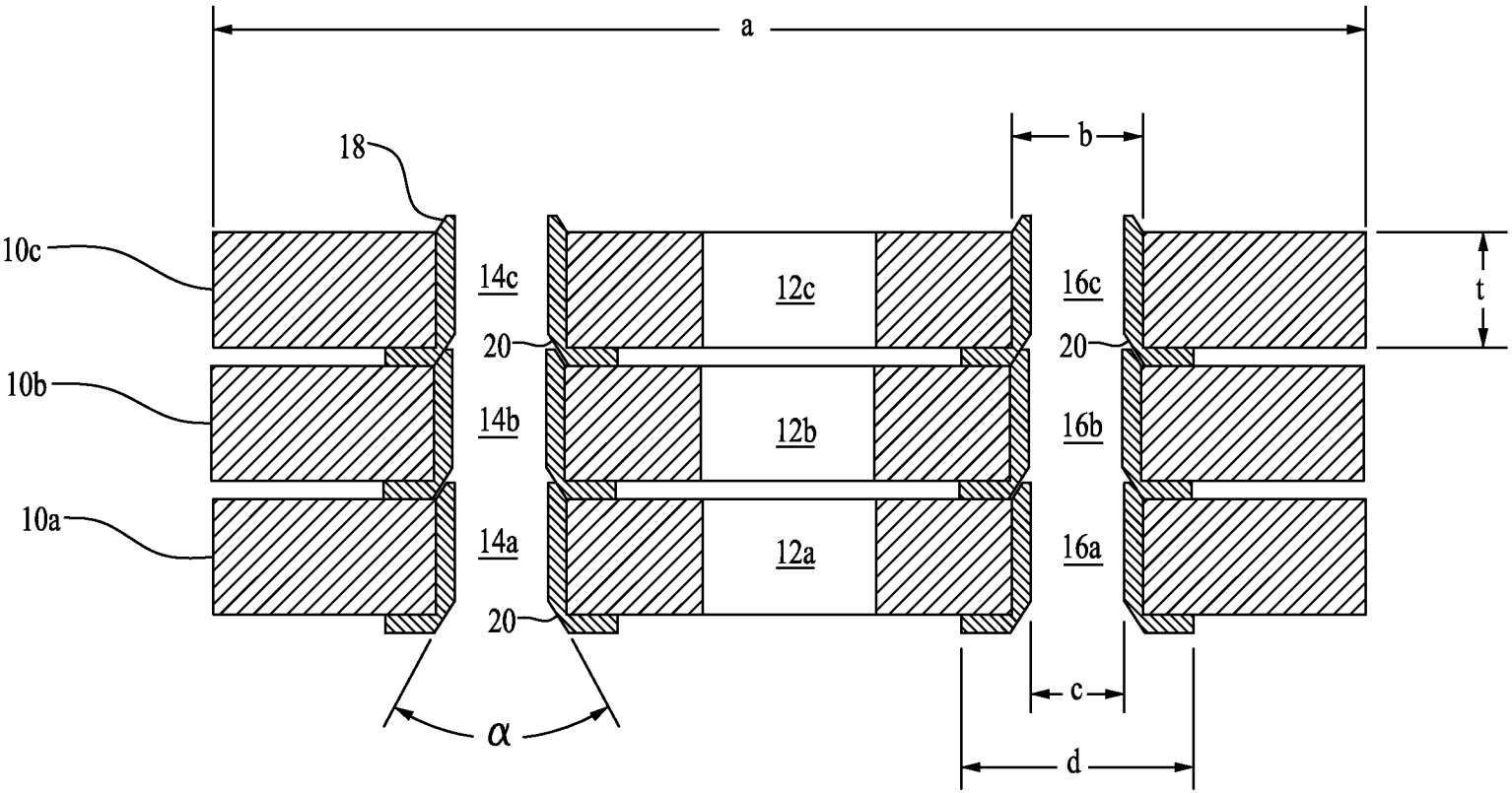
FIG. 1 is a sectional view in schematic of a preferred weight plate stack constructed in accordance with the invention, but comprising only three weight plates for the sake of clarity.
Figure 2:
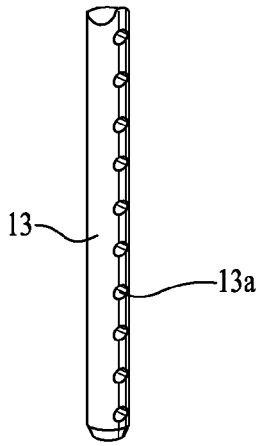
FIG. 2 is a left rear fragmentary view in perspective of a typical selector rod.

FIG. 1 is a sectional view in schematic of a preferred weight plate stack constructed in accordance with the invention, but comprising only three weight plates for the sake of clarity. The three weight plates 10*a*, 10*b*, 10*c* are stacked vertically, which is the typical orientation, with each weight plate having a generally central hole 12*a*, 12*b*, 12*c* for accommodating a selector rod 13 (FIG. 2) passing therethrough. As is known to those of ordinary skill in the art, the selector rod 13 has a plurality vertically-separated holes which are intended to generally align with respective selector pin-accommodating, transversely-extending holes in the weight plates so that a user can adjust the amount of weight to be lifted by inserting a selector pin through a transversely-extending hole in the front of the weight plate into the hole 13*a* aligned therewith.

Each plate further includes a pair of guide rod holes 14*a-c*, 16*a-c*. Each of the guide rod holes is associated with a beveled "male" surface 18 projecting upward from the top surface of the weight plate in which the hole is located, and also a beveled "female" surface 20 projecting downward from the bottom surface of the weight plate in which the hole is located. The male bevel 18 converges towards a central alignment axis in the upward direction, while the female bevel 20 diverges from the central alignment axis in the downward direction. These surfaces 18, 20 provide plate-to-plate alignment of the guide rod holes along respective axes of hole alignment. Accordingly, as will become clear, the male bevel surfaces may instead project downward from the bottom of each plate while the female bevel surfaces project upward from the plate. As will also become clear, many other configurations can be utilized which result in a male beveled surface of a weight plate mating with a female beveled surface of the adjacent weight plate in the stack. Moreover, as will also become clear, a beveled surface may be contained within the guide-rod hole rather than project outward from the hole, so long as such a mating is possible when the plates are closely adjacent.

Preferably the male and female bevel surfaces are formed at opposite ends of a bushing that is inserted through the guide-rod holes 14*a-c*, 16 *a-c* as illustrated in FIG. 1. The beveled surfaces may be radius, polygonal or faceted, and can be smooth or ribbed to assure grip tolerance. The use of bushing having a male and/or female bevel is advantageous in that it can be used with conventionally manufactured weight plates, thereby eliminating a requirement for specially configured weigh plates and the additional manufacturing cost associated therewith, while also permitting conventional weight plate stacks to be retrofit in accordance with the invention.

The bushing has an internal through-bore that is preferably 1/16 inch greater than the outer diameter of the guide rod, and its outer diameter is approximately 0.001 inches greater than the guide rod hole in the plate, so that it is press fit into the hole. Those skilled in the art will recognize that other means for affixing the bushing within the guide rod hole are available as well, but the press fit permits the bushing to be conveniently inserted, removed and replaced and without the need special equipment. In practice, bushings having an inner diameter of 0.780-0.812 inches have been found to be suitable when used with guide rods having an outer diameter of 0.750 inches to provide a clearance of 0.030-0.060 inches.

It is currently believed, as a general rule, that the preferred tolerances for the bushings are a function of the manufacturing tolerance for the guide rod holes in the weight plate. If the tolerance for the internal diameter of the guide rod hole is "x", the tolerance of the internal diameter of the alignment bushing should preferably be "x", and the tolerance of the bevel portion should preferably be no more than "x/2".

By way of example, and with reference to FIG. 1, the following nominal dimensions have been utilized in constructing an exercise machine in accordance with the invention:

b=1.125 inches
c=0.800 inches
d=2.00 inches
t=1.000 inch
$\alpha=60°$

Figure 3:
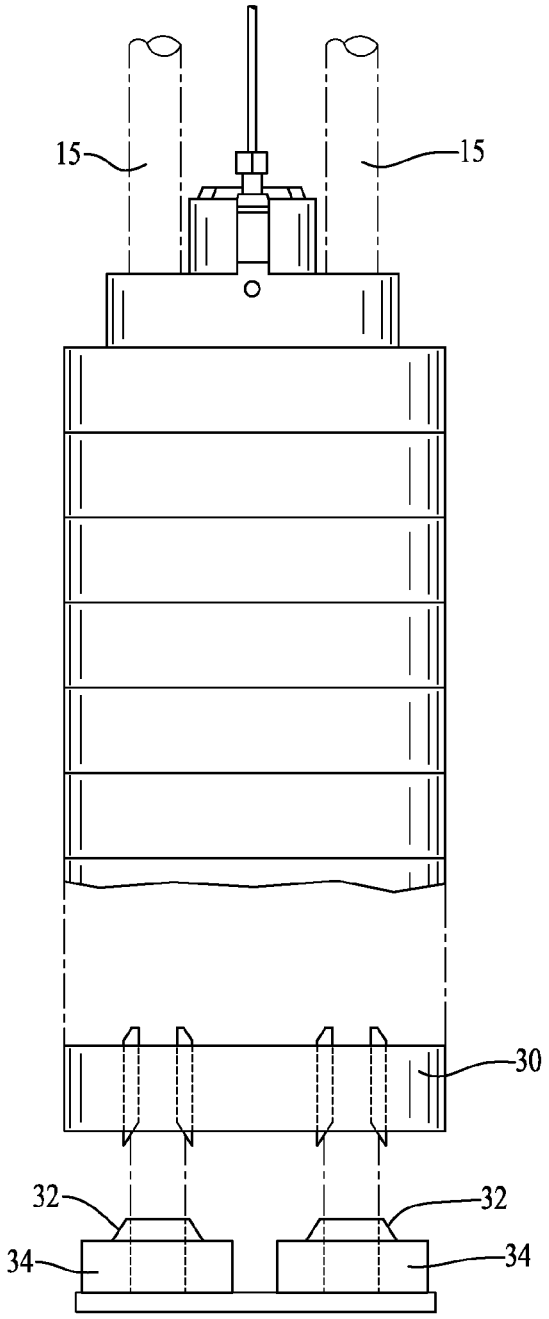
FIG. 3 is a rear elevation view of a weight plate stack mounted within a typical weight resistance machine.

FIG. 3 is a rear elevation view of a weight plate stack mounted within a typical weight resistance machine. In accordance with the invention, the bottommost weight plate 30 on the stack rests on a keystone surface 32 which is preferably provided by a pair of generally tubular keystone bushings 34. The keystone bushings can be similar to the aforedescribed alignment bushings, but have an interior diameter accommodating the guide rod 15 that is manufactured with a very tight tolerance; e.g., 0.085 inches with a tolerance of +0.005 inches, −0.000 inches for a 0.750 inch guide rod, thus accordingly reducing the clearance between the interior of the keystone bushing and the guide rod to 0.010-0.015 inches instead of the 0.030-0.060 inches associated with the alignment bushings.

The keystone bushing provides two functions. First, it securely and precisely locates the bottom ends of the guide rods to precisely define the distance between the guide rods. Secondly, the keystone surface precisely locates the resting stack with respect to the guide rods; owing to the consequential alignment of the stack by the keystone surface as described below, there is no contact between the guide rods and the interior of the alignment bushings.

Figure 4:
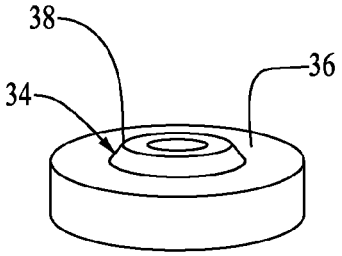
FIG. 4 is a perspective view of a preferred keystone bushing constructed in accordance with the invention.

FIG. 4 is a perspective view of a preferred keystone bushing. The bushing is positioned about the guide rods and below the stack, and is press-fit (or otherwise affixed) within a pad 36 or spring that supports the bottommost weight plate of the stack when it is in its lowermost "resting" position and provides resilient cushioning for the lowermost plate when it descends towards its resting position during an exercise movement. A male locating surface 38 is illustrated, although it should be noted that a female locating surface can be used as well, as described above with respect to the alignment bushings. Also, although a round locating surface is illustrated, trapezoidal, multi-faceted and polygonal shapes can be used as well. The bushing illustrated in FIG. 4 may be formed as an integral piece, or a bushing similar or identical in shape to that illustrated in FIG. 1 may be force fit or otherwise affixed within a pad or gasket 36 having a suitable shape or the illustrated shape.

In operation, the selected portion of the stack (i.e., that portion between and including the topmost plate and the pin-selected plate) moves as a unit, with virtually no crosswise (i.e., lateral) shifting among the plates because of the tight tolerances between the mating location surfaces of the alignment bushings. Moreover, there is virtually no friction between the moving portion of the stack and the guide rods because (1) the keystone bushing provides a virtually error free location reference for the moving stack by setting the non-selected portion of the stack at a highly accurate "home" position that resets the moving stack if it has shifted laterally with respect to the guide rods, even if that shift is very slight, and (2) the mating surfaces of the alignment bushings prevent the plates within the moving portion of the stack from shifting laterally with respect to each other and thereby contacting a guide rod.

Preferably, the internal diameters of the alignment bushings in one of the upper weight plates (preferably the topmost weight plate) is sized to provide a "bearing fit" with slightly less clearance around the guide rod than the "clearance fits" of the other guide bushings so that only that one plate (referred to as the "guide plate" herein) will make contact with the guide rod in a worst case situation. Thus, the amount of friction generated against the guide rods in the worst case situation will be limited and negligible, as the guide plate becomes mechanically guided by the guide rod via sliding contact while the remaining weight plates of the moving stack portion merely follow the position of the guide plate and remain free of contact owing to their greater clearance around the guide rods. A bearing or other component maybe utilized instead of a bushing with bearing fit, should one wish to do so without departing from the scope of the invention.

Any weight plate to be within the moving stack can be selected as the guide plate with the bearing fit (or bearing), but the topmost plate is preferred since it will always be within the moving portion of the stack. The preferred "bearing fit" clearance is approximately 0.005-0.010 inches, with an ID tolerance of +0.005, −0.000 inches. In this configuration, the guide plate has a bearing fit, the remaining plates have a clearance fit, and the location surface of the keystone bushing below the stack has an OD with a very tight tolerance because it is designed to provide a precise location reference and not move.

The result of the foregoing preferred configuration is that the user experiences a pleasant, virtually friction-free, bearing-like stack movement wherein the resistance during both the positive phase and negative phase of the exercise movement is essentially the same. The selector pin can be inserted and withdrawn smoothly because the plates are always aligned laterally and vertically, and the selector pin openings in the plates therefore always align with their corresponding pin holes in the selector rod. In addition, the aesthetics of both the moving and stationary portions of the stack is maintained because lateral plate shifting within the stack is virtually eliminated, particularly when the stack is at rest and referenced to the keystone location surface beneath the lowermost weight plate in the stack.

As indicated earlier, either the male location surface or the female location surface of the bushings can project upward, while the other of the pair projects downward. Moreover, those of ordinary skill in the art will recognize that some of the male surface can project upward and some downward, with the females arranged to mate with them by projecting downward and upward, respectively. Any arrangement and combination of upward/downward orientations is possible and is included within the scope of the invention to achieve the described effect.

A bushing system such as that in the preferred embodiment illustrated and described herein, can be used to retrofit conventionally made weight plate stacks so the actual hole size in the plate and the actual guide rod diameter does not matter. What is important is the tolerance between the mating male and female surfaces.

Any portion of the bushing lying outside the plate acts as a cushioning surface for the adjacent plate, and provides consistent spacing between plates that improves the visual appearance of the stack. It may also aid in maintaining alignment between the selector pin holes in the weight plate and selector rod.

Figure 5:
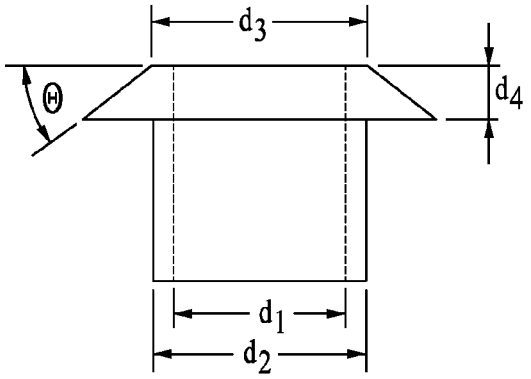
FIG. 5 is a front elevation view, in schematic, of an alternative guide bushing.

An alternative alignment bushing (and keystone bushing) is illustrated in FIG. 5. In this application, the female bevel is machined directly into the plate surface about the guide rod hole, and the illustrated bushing is inserted into the hole from the opposite surface of the plate. The bushing is sized to extend down into the hole, stopping just short of the position that will be reached by the mating male bevel of the adjacent weight plate in the stack. The preferred dimensions of the illustrated bushing are:

$d_1$=0.780-0.812 inches for a 0.750 inch diameter guide rod;

$d_2$=0.001 inches greater than the internal diameter of the guide rod-receiving hole;

$d_3$=a length sufficient to support the adjacent plate;

$d_4$=a length short enough to avoid pushing the adjacent bushing out of its hole when the male and female bevel surfaces have mated, but long enough to provide sufficient alignment force. Approx. 0.200 inches has been found to be suitable; and $\theta$=approximately 30°

It is understood by those of ordinary skill in the art that the dimensions, clearances and tolerances recited herein may vary to comply with holes sizes, shapes and positions, as well as guide rod shapes, sizes and positions, that are determined by designers and manufacturers of exercise equipment that utilize weight plate stacks. Moreover, clearances and tolerances may be varied by designer and manufactures of such equipment and components for such equipment without departing from the scope of the invention.

Although a preferred embodiment of the present invention and its advantages have been described in detail above, it should be understood that various details, changes, substitutions and alterations will be apparent to those of ordinary skill in the art having the benefit of the foregoing specification. It is intended that all such variations be within the scope and spirit of the invention, and that the invention be solely defined by appended claims that shall be given the broadest allowable interpretation consistent with the Doctrine of Equivalents.

The invention claimed is:

1. Exercise equipment comprising:

a stack of weight plates arranged from a topmost weight plate to a bottommost weight plate, each of said weight plates having a pair of guide rod openings for accommodating a respective guide rod therethrough, a pair of generally vertically-extending guide rods passing through respective guide rod openings of each weight plate in the stack, a user-selectable number of the weight plates being moveable along the guide rods in response to an exercise movement by a user of the equipment, a plurality of alignment members, each secured in a guide rod opening to provide a clearance fit around the guide rod passing therethrough, each shaped to mate with an adjacent alignment member of an adjacent plate in the stack to maintain alignment of the adjacent guide rod openings; and a keystone surface positioned below the stack to provide a precise setting of the stack's lateral position by mating with a mating surface carried by the bottommost weight plate, thereby aligning the aligned guide rod openings with the respective guide rod passing therethrough.

2. The exercise equipment of claim 1 wherein the guide rod openings of at least one of the weight plates in the top region of the stack has a bearing fit with the respective guide rod passing therethrough, said bearing fit being characterized by less clearance with the guide rod than the clearance fit of the other weight plates so that said at least one plate will make contact with a guide rod before plates with a clearance fit do.

3. The exercise equipment of claim 1 wherein the clearance fit is substantially $1/16^{th}$ of an inch larger than the outer dimension of the guide rod.

4. The exercise equipment of claim 1 wherein the keystone location surface is dimensioned to provide an alignment tolerance of substantially 0.005 inches.

5. The exercise equipment of claim 4 wherein the keystone location surface is positioned to accommodate a bottom portion of the guide rod opening of the bottommost weight plate.

6. The exercise equipment of claim 1 wherein the alignment member includes a beveled male surface projecting upward from the guide rod opening at the top surface of the weight plate.

7. The exercise equipment of claim 6 wherein the alignment member includes a beveled female surface projecting downward from the guide rod opening at the bottom surface of the weight plate.

8. The exercise equipment of claim 1 the alignment member includes a beveled female surface projecting upward from the guide rod opening at the top surface of each weight plate.

9. The exercise equipment of claim 8 wherein the alignment member includes a beveled male surface projecting downward from the guide rod opening at the bottom surface of each weight plate.

10. The exercise equipment of claim 1 wherein the alignment member includes an upward-projecting beveled male surface within the guide rod opening of the weight plate.

11. The exercise equipment of claim 10 wherein the alignment member includes a downward-projecting female surface within the guide rod opening of the weight plate.

12. The exercise equipment of claim 1 wherein the alignment member includes an upward-projecting beveled female surface within the guide rod opening of the weight plate.

13. The exercise equipment of claim 12 wherein the alignment member includes a downward-projecting beveled male surface within the guide rod opening of the weight plate.

14. The exercise equipment of claim 1 wherein the alignment member includes a gasket dimensioned to fit within the guide rod opening of a weight plate with a press fit, said gasket having an internal passage defining a clearance fit with a guide rod passing therethrough, and having a beveled male alignment surface positioned to mate with the alignment member of an adjacent weight plate in the stack.

15. The exercise equipment of claim 14 wherein the gasket has a beveled female alignment surface positioned to mate with an alignment member of an adjacent weight plate in the stack.

16. The exercise equipment of claim 1 wherein the alignment member includes a gasket dimensioned to fit within the guide rod opening of a weight plate with a press fit, said gasket having an internal passage defining a clearance fit with a guide rod passing therethrough, and having a beveled female alignment surface positioned to mate with an alignment member of an adjacent weight plate in the stack.

17. The exercise equipment of claim 1 wherein the a keystone surface comprises a bushing positioned about a guide rod and having a beveled male locating surface that mates with the bottom portion of the bottommost weight plate in the stack with a very tight alignment tolerance.

18. The exercise equipment of claim 17 wherein the bushing is secured within a pad that supports the bottommost weight plate when the weight plate is in its lowermost position.

19. The exercise equipment of claim 18 wherein the bushing is secured within a spring that supports the bottommost weight plate when the weight plate is in its lowermost position.

* * * * *